US005397012A

United States Patent [19]

Tison et al.

[11] Patent Number: 5,397,012

[45] Date of Patent: Mar. 14, 1995

[54] TAMPER-PROOF SEALING PLUG ASSEMBLY

[75] Inventors: Marc Tison, St-Hubert; Christian Major, Montréal; Brad Wood, Beaconsfield, all of Canada

[73] Assignee: Payge International Inc., Montréal, Canada

[21] Appl. No.: 114,368

[22] Filed: Sep. 1, 1993

[51] Int. Cl.[6] ..... B65D 51/16

[52] U.S. Cl. ..... 220/214; 220/268; 220/375; 220/725; 215/253; 215/306

[58] Field of Search ..... 220/214, 268, 269, 375, 220/724, 725; 215/228, 250, 251, 252, 253, 306, 355; 222/153

[56] References Cited

U.S. PATENT DOCUMENTS

| | | | |
|---|---|---|---|
| 2,838,200 | 6/1958 | Brewer | 220/214 |
| 3,125,242 | 3/1964 | Davis | 220/724 |
| 3,974,938 | 8/1976 | Steadman | 215/306 X |
| 4,550,842 | 11/1985 | Cummings . | |
| 4,588,218 | 5/1986 | Guiler et al. . | |
| 4,697,833 | 10/1987 | Swift . | |
| 4,892,208 | 1/1990 | Sledge | 215/306 X |
| 4,899,781 | 2/1990 | Monroe | 220/214 X |
| 4,940,268 | 7/1990 | Lesquir et al. . | |
| 5,116,091 | 5/1992 | Swift . | |
| 5,118,148 | 6/1992 | De Lima Castro Netto . | |
| 5,183,301 | 2/1993 | Lundberg, Jr. . | |
| 5,191,992 | 3/1993 | Darley | 220/214 |

FOREIGN PATENT DOCUMENTS

| | | | |
|---|---|---|---|
| 1292405 | 3/1962 | France | 220/725 |

*Primary Examiner*—Allan N. Shoap
*Assistant Examiner*—Jes F. Pascua
*Attorney, Agent, or Firm*—Robic

[57] ABSTRACT

A plastic tamper-proof sealing plug assembly for use in securely sealing the vale outlet of a pressurized bottle or any other type of container. The tamper-proof assembly has a tubular gasket provided with a central opening, sized to fit into and seal a valve outlet, and a sealing plug element with a plug projecting from it, which is sized to snugly fit into the tubular gasket in order to close the valve outlet. The tamper-proof assembly also has a security seal in the form of a strap has one end attached to one side of the sealing plug element and also has another free end. The strap projects outwards from the side of the sealing plug element and is long enough to surround the valve. The tamper-proof assembly further has a fastener for irreversibly fastening the free end of the strap to the sealing plug element so that the strap must be broken in order to remove the plug and the gasket if necessary, from the valve outlet. This gives a visible indication to anyone using the bottle that the plug and the gasket have previously been removed or tampered with. This assembly may also consist of a moulded, one-piece tamper-proof assembly where the gasket and the sealing plug element are combined together in a combined gasket and sealing plug element unit. However, when the gasket and the sealing plug element are moulded into a one-piece tamper-proof assembly, they are separated from one another before they are installed on the valve outlet.

10 Claims, 4 Drawing Sheets

TAMPER-PROOF SEALING PLUG ASSEMBLY

BACKGROUND OF THE INVENTION a) Field of the Invention

This invention relates to a tamper-proof sealing plug assembly comprising, in combination, a gasket sized to fit into a valve outlet of a pressurized bottle, a tamper-proof sealing plug for closing the valve outlet to prevent dust from entering the valve outlet, and a security seal for giving a visible indication whenever the plug and the gasket are removed.

b) Brief Description of the Prior Art

Security seals comprising a one-piece moulded flexible strap having a locking mechanism integral at one end and at least one tooth at its other free end to make this free end irreversibly insertable into the locking mechanism, are well known and commonly used for industrial applications. The strap forms a closed loop when its free end is inserted into the locking mechanism and this loop may be mounted around an object, for example the neck of a money bag, or between two elements in order to protect said object from being tampered with or said elements from being separated.

In U.S. Pat. Nos. 4,588,218; 4,697,833 and 5,116,091, flexible straps are disclosed, which have a protrusion or stud at one end and a locking mechanism at the other end. This mechanism includes internal fingers for irreversibly receiving the protrusion inside the housing.

In U.S. Pat. No. 5,183,301, there is disclosed a flexible strap having a locking mechanism with a passageway at one end, and a pointed free end that is insertable through the passageway. There are facilities on the strap and in the passageway, which permit the insertion of the strap into the passageway but which also prevent the strap from being withdrawn out of the passageway. The strap must be broken in order to remove it from the passageway.

In U.S. Pat. No. 4,940,268, there is disclosed a flexible strap having a fastener attached at one end and a small catch defined in the same end of the strap. The strap is foldable into a ring to engage the catch. The fastener can also be received in the catch and when it does, it may be forcingly engaged into a series of holes in the strap.

Hitherto, it has also been common to have a plastic sealing cover or the like for securely sealing the top of a bottle to ensure that the top has not been opened or tampered with in any way.

U.S. Pat. No. 4,550,842 describes a seal for protecting the sterile contents of bottles used in blood transfusions against tampering or contamination. The sealing cover comprises a container-cover area and a pull-tab area. The container-cover comprises an upper layer of plastic film impervious to bacteria to which is bonded another layer of orientated film which promotes tearing when the container-cover is removed with the pull-tab. An adhesive material is bonded to the orientated film in order to engage and seal the top of the bottle.

Just like these bottles of sterile solution, pressurized gas—or liquid—containing bottles with tubing connected thereto through an outlet valve, such as oxygen bottles as used in hospitals, should also be kept securely sealed before their use, for a number of reasons.

First, in order to insure that the tubing stays connected to the outlet valve of these bottles, an airtight joint or gasket could be used for sealing the valve outlet of the bottle, while leaving an opening in the outlet.

Secondly, dust or other particles may enter the bottle through the valve outlet between the time of filling-up the bottle and that of using the bottle for the first time. Therefore, there would certainly be an advantage in having some sort of closure placed over the valve outlet in order to close this outlet.

Finally, problems may arise when people cannot tell whether or not a bottle has already been used, or more importantly whether the bottle has been tampered with. Therefore, there would also be an advantage in having some sort of security seal which would provide the user with a visual indication if the bottle had been opened and/or had been tampered with.

SUMMARY OF THE INVENTION

Therefore, it is an object of the present invention to provide a tamper-proof sealing plug assembly for use on, but not exclusively, pressurized liquid—or gas—-containing bottles, the sealing-plug assembly comprising a tubular gasket provided with a central opening, sized to fit into and seal a valve outlet of a bottle while leaving its opening as an opening in the outlet and a sealing plug element having at least one flat surface, the element having a plug projecting from the flat surface which is sized to snugly fit into the tubular gasket in order to close the opening left in the outlet of the bottle.

The tamper-proof sealing plug assembly also comprises a security seal in the form of a strap having an end which is attached to one side of the sealing plug element and is provided with a thin portion which forms a weakness point where the strap is attached to the side of the sealing plug element, so that when the strap is under stress from external pressure, it breaks at the weakness point. The end of the strap projects laterally outwards from the side of the element. The strap is made long enough to surround the valve of the bottle and the strap also has another free end.

Means are provided for irreversibly fastening the free end of the strap to the sealing plug element so that the strap has to be broken in order to remove the plug and optionally the gasket from the valve outlet of the bottle. This therefore gives a visible indication that the plug and the gasket have been tampered with.

According to a preferred embodiment of the invention, the tamper-proof sealing plug assembly is made of one-piece of moulded plastic material. In such a case, the gasket and the sealing plug element described hereinabove are combined together into a combined gasket and sealing plug element unit that is foldable and then breakable along a transversal line in order to separate the gasket from the sealing plug element before they are installed on the valve outlet. The element has at least one flat surface and is located on one side of the transversal line whereas the gasket is provided with a central opening and is positioned on an opposite side of the transversal line. The sealing plug element has a projecting plug located on the flat surface that is sized to snugly fit into the gasket, in order to close the opening left in the outlet of the bottle.

The moulded one-piece assembly described hereinabove, also comprises a security seal in the form of a strap like that described earlier but the strap projects outwards from the side of the sealing plug element in a direction that is generally parallel to the transversal line.

The moulded one-piece assembly described hereinabove further comprises means which are integral to the sealing plug element, for irreversibly fastening the free end of the strap to the sealing plug element.

According to another preferred embodiment of the invention, the free end of the strap is provided with at least one tooth and is insertable into a locking mechanism of the ratchet type which is integral with the sealing plug element.

BRIEF DESCRIPTION OF THE DRAWINGS

The invention and its advantages will be better understood upon reading the following non restrictive description of a preferred embodiment of it, reference being made to the accompanying drawings in which.

In the following description, the same reference numerals apply to all Figures.

DESCRIPTION OF PREFERRED EMBODIMENTS OF THE INVENTION

The tamper-proof sealing plug assembly according to the invention as shown in the accompanying drawings is a moulded, one-piece assembly 1. However, this assembly could also come in two separately moulded parts as will be described below.

Figure 1:
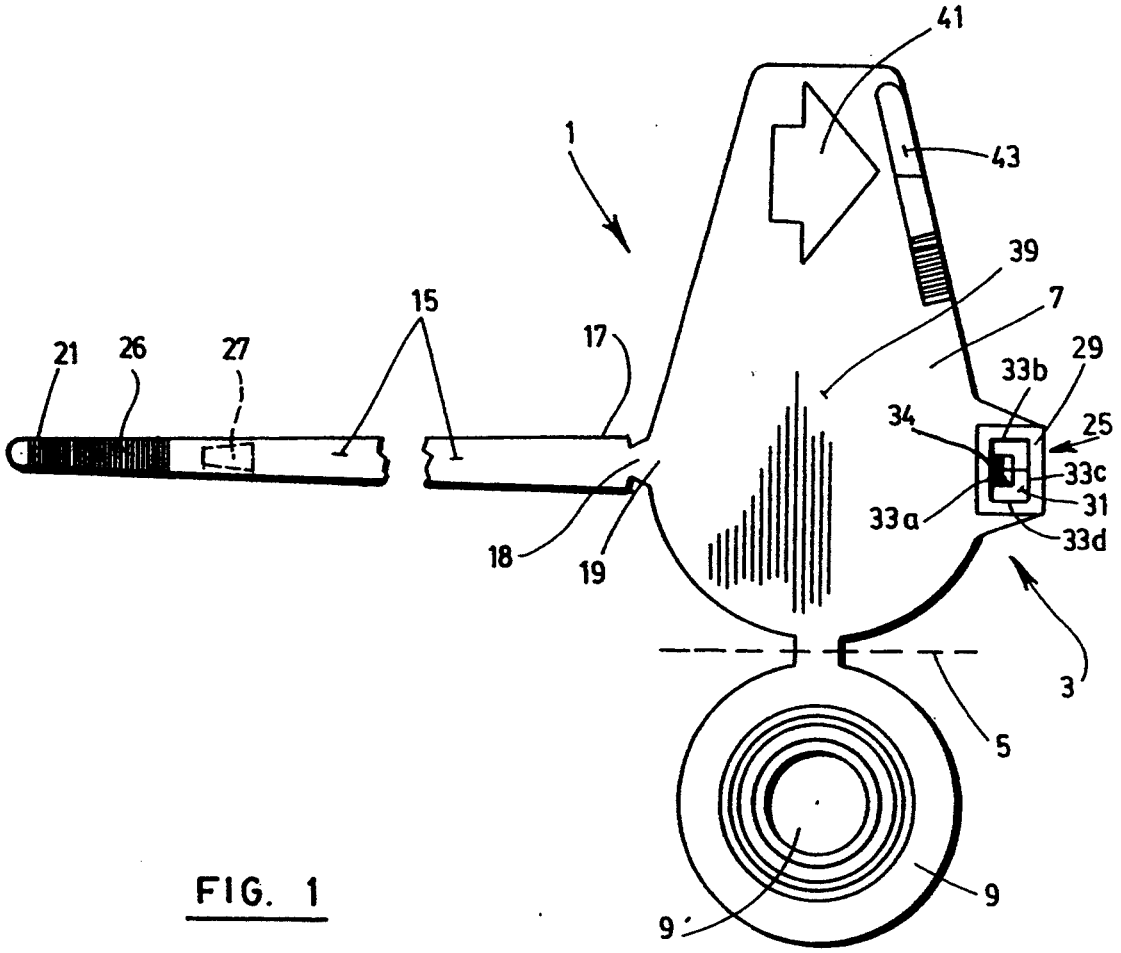
FIG. 1 is a top plan view of a moulded, one-piece tamper-proof sealing plug assembly according to the invention, showing its strap partially cut.
Figure 3:
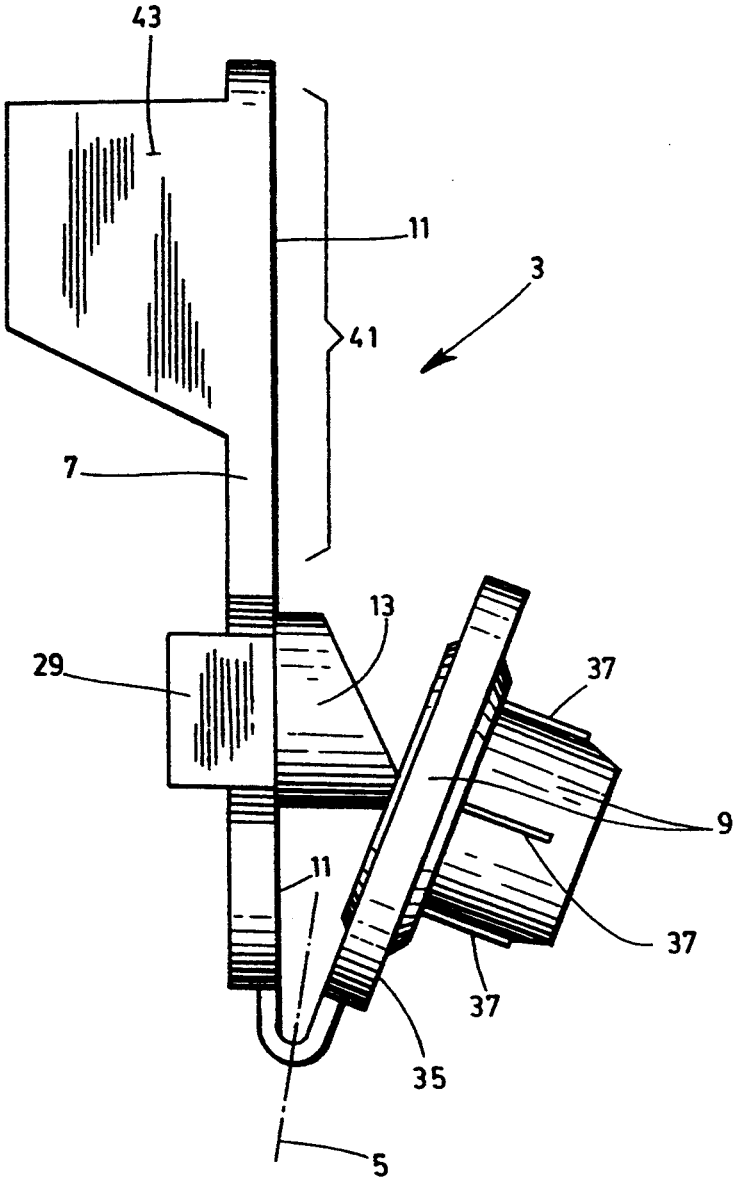
FIG. 3 is a view similar to the one of FIG. 2, showing the combined gasket and sealing plug element unit folded along its transversal line shown in dotted lines in order to break the unit into two separate parts namely the gasket and the sealing plug element.

As is better shown in FIG. 1, the one-piece tamper-proof sealing plug assembly 1 comprises a combined gasket and sealing plug element unit 3 which is foldable and then breakable along a transversal line 5. The unit 3 comprises a sealing plug element 7 located on one side of the transversal line 5 and a gasket 9 provided with a central opening 9′ located on an opposite side of the transversal line 5. The combined gasket and sealing plug element unit is folded (as shown in FIG. 3) and broken along the transversal line in order to separate the gasket from the sealing plug element before they are installed on a valve outlet of a bottle. The gasket 9 is shaped and sized so as to fit into, and seal the valve outlet while leaving its opening 9′ as an opening in the outlet.

Figure 2:
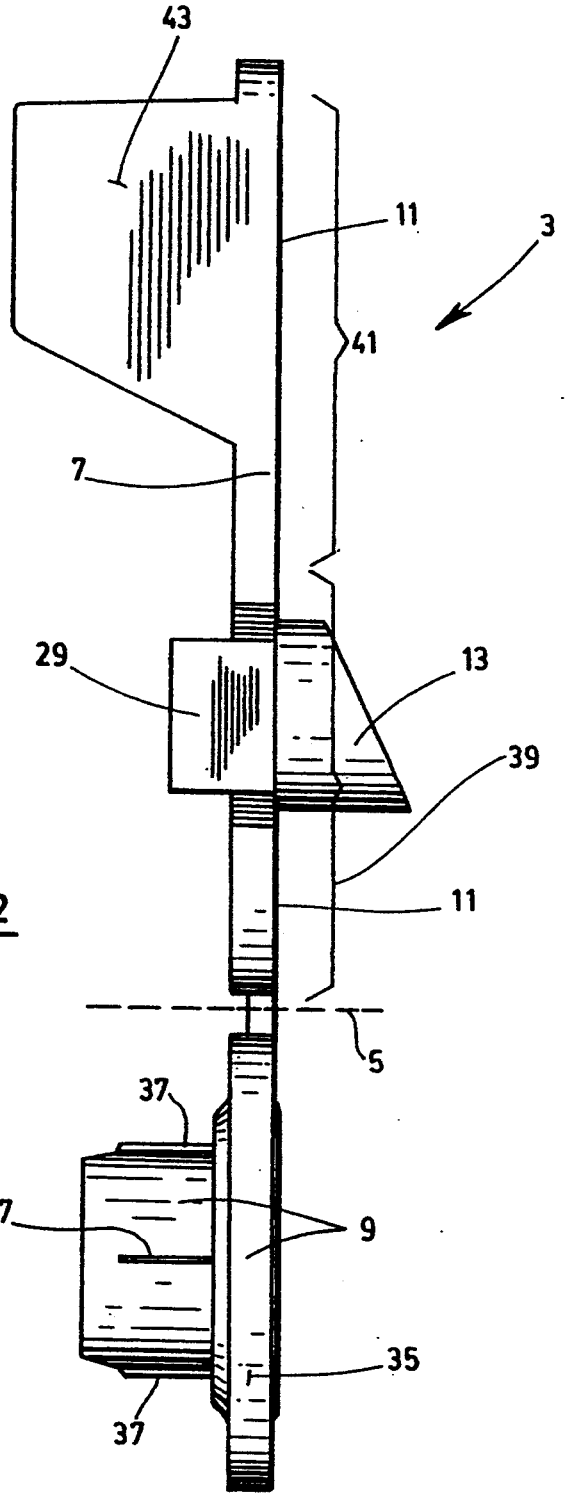
FIG. 2 is a side plan view of the combined gasket and sealing plug element unit which is a part of the moulded, one-piece tamper-proof assembly shown in FIG. 1, with the sealing plug element located on one side of the transversal line shown in dotted lines, and the gasket located on an opposite side of the line.

As is better shown in FIG. 2, the sealing plug element 7 has a flat surface 11 from which projects a plug 13.

As is better shown in FIG. 3, the projecting plug 13 that is located on the flat surface 11 of the sealing plug element 7 is sized to snugly fit into the gasket 9, so as to close the opening 9′ left in the outlet and prevent dust or other particles from entering the outlet.

As is better shown in FIG. 1, the one-piece tamper-proof sealing plug assembly 1 also comprises a security seal in the form of a strap 15 that has an end 17 attached to one side 19 of the sealing plug element 7 and another free end 21. The end 17 is provided with a thin portion 18 which forms a weakness point where the strap 15 is attached to the side 19 of the sealing plug element 7, so that when the strap 15 is under stress from external pressure, it breaks at the weakness point. The strap 15 projects outwards from the side 19 of the sealing plug element 7 in a direction that is generally parallel to the transversal line 5.

Figure 4:
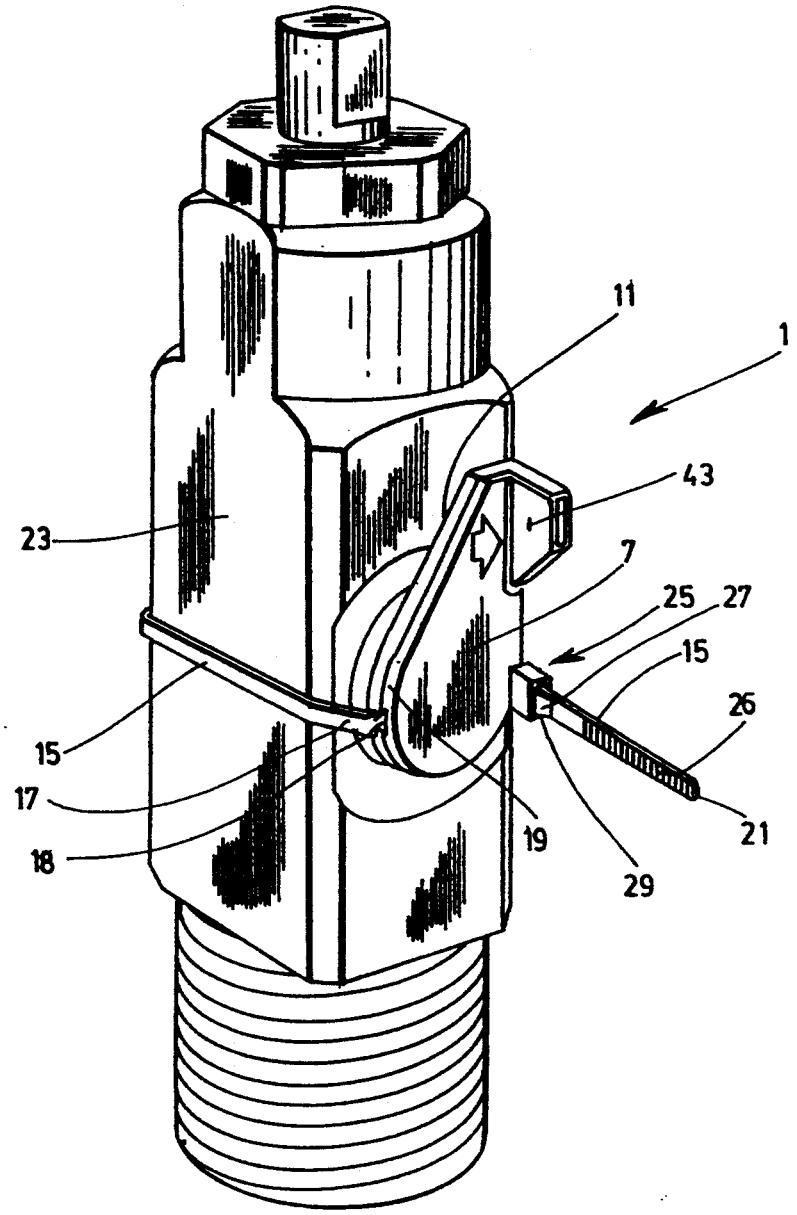
FIG. 4 is a perspective view of the moulded one-piece tamper-proof assembly shown in FIGS. 1 to 3, with the gasket and the sealing plug element in position inside and over the valve outlet of a bottle, and the strap surrounding the valve of the bottle and inserted into a locking mechanism which is integral to the sealing plug element.

As is better shown in FIG. 4, the strap 15 is made long enough to surround the valve 23 of a bottle.

Turning back to FIG. 1, the one-piece tamper-proof sealing plug assembly 1 further comprises means 25 which are integral to the sealing plug element 7 for irreversibly fastening the other free end 21 of the strap 15 to the sealing plug element 7 (as shown in FIG. 4). In this way, the strap 15 must be broken in order to remove the plug 13 and optionally the gasket 9 from the valve outlet, thereby giving a visible indication that the plug 13 and the gasket 9 have been tampered with or previously removed.

As was explained above, the tubular gasket 9 and the sealing plug element 7 of the tamper-proof sealing plug assembly, can also be separately moulded in two pieces. However, in such a case, the gasket 9 must still be sized to fit into and seal a valve outlet while leaving an opening 9′ in the outlet. When the gasket 9 is in the valve outlet, the projecting plug 13 on the flat surface 11 of the sealing plug element 7 fits into the tubular gasket 9 to close the opening 9′ left in the outlet.

This two-piece tamper-proof sealing plug assembly (not shown) also comprises a security seal like that described hereinabove, which projects laterally outwards from the side 19 of the sealing plug element 7. This two-piece tamper-proof sealing plug assembly further comprises means 25 for irreversibly fastening the other free end 21 of the strap 15 to the sealing plug element 7.

This two-piece tamper-proof sealing assembly is therefore similar to the one-piece assembly disclosed hereinabove, except that its gasket and sealing plug element are not hinged to each other.

As is better shown in FIG. 4, the free end 21 of the strap 15 is provided with a plurality of grooves 26 which prevent the strap 15 from sliding in between the fingers of a person using the assembly 1, and at least one tooth 27. This end 21 is insertable into a locking mechanism 29 preferably of the ratchet type, which is integral with the sealing plug element 7.

The means for irreversibly fastening the free end 21 of the strap 15 to the sealing plug 7 need not be a locking mechanism even though such is preferred. The free end 21 of the strap 15 could be provided with an adhesive strip which would allow the strap 15 to be bonded or glued to the sealing plug element 7.

This means could also consist of a locking mechanism comprising a small stud located at the free end 21 of the strap 15, which would be insertable into a socket integral with the sealing plug element 7, comprising a set of fingers that could retain the stud inside the socket. Therefore, the strap 15 should be broken in order to remove the plug and optionally the gasket from the valve outlet, thereby giving a visible indication that the plug and the gasket were tampered with or previously open.

As is better shown in FIG. 1, the locking mechanism 29 that is illustrated comprises a rectangular passageway 31 having four interior surfaces 33*a*, 33*b*, 33*c* and 33*d*. One of the four surfaces 33*a* is provided with a small tongue 34 which is directed at an angle outside the passageway 31.

The free end 21 of the strap 15 deflects the small tongue 34 when it passes through the passageway 31, and once the strap 15 has pushed the small tongue 34 aside, the tongue 34 and the at least one tooth 27 of the strap 15 are so positioned as to block the strap 15 from disengaging back out of the passageway 31 of the locking mechanism 29.

It should be pointed out that the number of teeth 27 provided at the free end 21 of the strap 15, may vary from at least one tooth 27 to a plurality of teeth 27.

As is better shown in FIGS. 2 and 3, the gasket 9 is cylindrically shaped and has an outer rim 35. The gasket 9 also has a plurality of longitudinal flanges 37 extending externally outwards and slightly exceeding the size of the opening 9' in the outlet of the bottle. This is necessary in order to provide a forced and solid insertion of the gasket 9 into the outlet.

The flat surface 11 of the sealing plug element 7 comprises a main portion 39 and a second elongated portion 41 integral with the main portion 39.

Turning back to FIG. 1, the strap 15 and the ratchet type locking mechanism 29 are attached on opposite sides of the main portion 39. The main portion 39 of the sealing plug element 7 defines a flange surrounding the plug 13.

As is better shown in FIGS. 2, 3 and 4, the elongated portion 41 of the sealing plug element 7 has a projection 43 extending at a right angle to the flat surface 11 of the element 7. The projection 43 is positioned near the locking mechanism 29 where the strap 15 is irreversibly fastened to the sealing plug element 7, so that when pressure is applied on the projection 43, the strap 15 is under stress and is broken at the weakness point where the strap 15 is attached to the side 19 of the sealing plug element 7. The plug 13 is then removed from the gasket 9.

The moulded one-piece tamper-proof sealing plug assembly 1 as shown in FIG. 1 can be installed on a valve outlet of a pressurized liquid or gas containing bottle as follows. Firstly, the combined gasket and sealing plug element unit 3 is folded and broken along a transversal line 5 in order to separate the gasket 9 from the sealing plug element 7 before they are installed on the valve outlet of the bottle. Once this is done, the gasket 9 which is provided with a central opening 9' is inserted into the valve outlet so as to seal the outlet while leaving its opening 9' as an opening in the outlet. The projecting plug 13 on the flat surface 11 of the sealing plug element 7, is then inserted into the gasket 9 in order to close the opening 9' left in the outlet. Once the outlet is completely sealed and closed, the security seal or strap 15 surrounds the valve 23 of the bottle and the free end 21 of the strap 15 is inserted into the locking mechanism 29 that is integral to the sealing plug element 7 as shown in FIG. 4.

In order to remove the plug 13 and optionally the gasket 9 from the valve outlet to use the bottle, the strap must be broken since it is irreversibly fastened to the sealing plug element 7.

Although the present invention has been explained hereinafter by means of preferred embodiments thereof, it should be pointed out that any modifications to these preferred embodiments, within the scope of the appended claims, are not deemed to change or alter the nature and scope of the present invention.

What is claimed is:

1. A tamper-proof sealing plug assembly comprising:

a tubular gasket provided with a central opening, sized so as to fit into and seal a valve outlet while leaving its opening as an opening in said outlet;

a sealing plug element having at least one flat surface, said element having a plug projecting from said at least one flat surface, said plug being sized to snugly fit into said tubular gasket in order to close said opening left in said outlet;

a security seal in the form of a strap having an end attached to one side of said sealing plug element, said end being provided with a thin portion which forms a weakness point where said strap is attached to said side of said sealing plug element, so that when said strap is under stress from external pressure, it breaks at the weakness point, said strap projecting laterally outwards from said side of said sealing plug element and being long enough to surround said valve, said strap having another free end; and means for irreversibly fastening said other free end of the said strap to said sealing plug element; whereby said strap must be broken in order to remove said plug and optionally said gasket from said valve outlet, thereby giving a visible indication that said plug and said gasket have been tampered with or previously removed.

2. The assembly of claim 1, wherein said free end of said strap is provided with a plurality of grooves and at least one tooth, said grooves preventing said strap from sliding in between fingers of a person using said assembly, said free end being insertable into a locking mechanism of the ratchet type which is integral with said sealing plug element.

3. The assembly of claim 2, wherein said locking mechanism comprises a rectangular passageway having four interior surfaces, one of the four surfaces being provided with a small tongue which is directed outside said passageway, said free end of said strap deflects said small tongue when it passes through said passageway, and once said strap has pushed said small tongue aside, said tongue and said at least one tooth are so positioned as to block said strap from disengaging back out of said passageway.

4. The assembly of claim 1, wherein said gasket is cylindrically shaped and has an outer rim, said gasket also having a plurality of longitudinal flanges extending externally outwards, said flanges slightly exceeding the size of said opening in said outlet, to provide a forced and solid insertion of said gasket into said outlet.

5. The assembly of claim 1, wherein said flat surface of said sealing plug element comprises a main portion on opposite sides of which said strap and said ratchet-type locking mechanism are attached, said main portion of said element defining a flange surrounding said plug, said sealing plug element also comprising a second elongated portion integral with said main portion, said elongated portion having a projection extending at a right angle to said flat surface of said element, said protection being positioned near said locking mechanism where said strap is irreversibly fastened to said sealing plug element, so that when pressure is applied on said projection, said strap is broken at said weakness point where said strap is attached to said side of said sealing plug element, and said plug is removed from said gasket.

6. A plastic moulded, one-piece tamper-proof sealing plug assembly comprising:

a combined gasket and sealing plug element unit foldable and then breakable along a transversal line, said unit comprising a sealing plug element located on one side of said transversal line and having at least one flat surface, said unit also comprising a gasket provided with a central opening, positioned on an opposite side of said transversal line, said combined gasket and sealing plug element unit is folded and broken along the transversal line in order to separate the gasket from the sealing plug element before they are installed on a valve outlet of a bottle, said gasket sized so as to fit into and seal the valve outlet while leaving its opening as an opening in said outlet, said sealing plug element having a projecting plug located on said at least one flat surface that is sized to snugly fit into said gasket, in order to close said opening left in said outlet;

a security seal in the form of a strap having an end attached to one side of said sealing plug element, said end being provided with a thin portion which forms a weakness point where said strap is attached to said side of said sealing plug element, so that when said strap is under stress from external pressure, it breaks at the weakness point, said strap projecting outwards from said side of said sealing plug element in a direction that is generally parallel to said transversal line, said strap being long enough to surround said valve, and having another free end; and means integral to said sealing plug element for irreversibly fastening said other free end of said strap to said sealing plug element;

whereby said strap must be broken in order to remove said plug and optionally said gasket from said valve outlet, thereby giving a visible indication that said plug and said gasket have been tampered with or previously removed.

7. The assembly of claim 6, wherein said free end of said strap is provided with a plurality of grooves and at least one tooth, said grooves preventing said strap from sliding in between fingers of a person using said assembly, said free end being insertable into a locking mechanism of the ratchet type which is integral with said sealing plug element.

8. The assembly of claim 7, wherein said locking mechanism comprises a rectangular passageway having four interior surfaces, one of the four surfaces being provided with a small tongue which is directed outside said passageway, said free end of said strap deflects said small tongue when it passes through said passageway, and once said strap has pushed said small tongue aside, said tongue and said at least one tooth are so positioned as to block said strap from disengaging back out of said passageway.

9. The assembly of claim 6, wherein said gasket is cylindrically shaped and has an outer rim, said gasket also having a plurality of longitudinal flanges extending externally outwards, said flanges slightly exceeding the size of said opening in said outlet, to provide a forced and solid insertion of said gasket into said outlet.

10. The assembly of claim 6, wherein said flat surface of said sealing plug element comprises a main portion on opposite sides of which said strap and said ratchet-type locking mechanism are attached, said main portion of said element defining a flange surrounding said plug, said sealing plug element also comprising a second elongated portion integral with said main portion, said elongated portion having a projection extending at a right angle to said flat surface of said element, said projection being positioned near said locking mechanism where said strap is irreversibly fastened to said sealing plug element, so that when pressure is applied on said projection, said strap is broken at said weakness point where said strap is attached to said side of said sealing plug element, and said plug is removed from said gasket.

* * * * *